US005893187A

United States Patent [19]

Fukuoka

[11] Patent Number: 5,893,187

[45] Date of Patent: Apr. 13, 1999

[54] REINFORCING STRUCTURE FOR HINGE SECTION OF GERBER BRIDGE

[75] Inventor: Katsumi Fukuoka, Fukuoka, Japan

[73] Assignee: Kyouryou Hozen Inc., Onojo, Japan

[21] Appl. No.: 08/750,637

[22] PCT Filed: Apr. 17, 1996

[86] PCT No.: PCT/JP96/01042

§ 371 Date: Dec. 16, 1996

§ 102(e) Date: Dec. 16, 1996

[87] PCT Pub. No.: WO96/33311

PCT Pub. Date: Oct. 24, 1996

[30] Foreign Application Priority Data

Apr. 21, 1995 [JP] Japan ..... 7-120874

[51] Int. Cl.[6] ..... E01D 19/04; E01D 21/00

[52] U.S. Cl. ..... 14/74.5; 14/77.1

[58] Field of Search ..... 14/73.1, 73.5, 14/74, 74.5, 77.1, 73; 404/50, 51, 53, 54, 56

[56] References Cited

U.S. PATENT DOCUMENTS 4,876,759 10/1989 Yang ..... 404/54 X

FOREIGN PATENT DOCUMENTS

| | | | |
|---|---|---|---|
| U-52-70728 | 5/1977 | Japan . | |
| 2-164902 | 6/1990 | Japan | 14/73.5 |
| A-3-25106 | 2/1991 | Japan . | |
| B2-3-30641 | 5/1991 | Japan . | |
| 7-62610 | 3/1995 | Japan . | |

*Primary Examiner*—James Lisehora

*Attorney, Agent, or Firm*—Griffin, Butler, Whisenhunt & Szipl, LLP

[57] ABSTRACT

A reinforcing structure for a hinge section of a Gerber bridge including first and second girders (10, 11) which are connected with each other through the hinge section, comprises reinforcing steels (13*a*, 14*a*) continuously established on at least one of upper and lower surfaces of the first and second girders (10, 11) and reinforcement (13, 14) established by covering at least one of the upper and lower surfaces of the first and second girders on which the reinforcing steels are established, with curing material so as to integrally connect the first and second girders (10, 11) with each other. By making the hinge section to be continuous between the first and second girders to thereby establish the Gerber bridge as a continuous bridge, the Gerber bridge can have the same structure as a continuous bridge which transfers bending moment therethrough, and thus can obtain superior reinforcement effects and long-term stability.

8 Claims, 6 Drawing Sheets

10
11
13
14
15
15a
15b
15c
22
H
M1

REINFORCING STRUCTURE FOR HINGE SECTION OF GERBER BRIDGE

TECHNICAL FIELD

The present invention relates to a reinforcing structure for a hinge section of a Gerber bridge.

BACKGROUND ART

A Gerber bridge having a hinge section or a connecting section in a continuous girder not only has the same advantages as those of a continuous bridge, but also is externally, statically determinate, so that differential settlement of supporting points does not occur in a Gerber bridge, and a Gerber bridge is not influenced by temperature changes. In addition, since it is possible in a Gerber bridge to decrease dead-load stress in comparison with a single girder, a Gerber bridge is advantageously adopted in a long span, a cross-section of which is dominated with dead-load. Thus, a Gerber bridge is often used as a steel made bridge or a concrete made bridge reinforced with steel bars.

There have often occurred breakages of bridges caused by rapidly increased traffic volume and heavy loads mounted on a heavy trucks. In particular, bridges established in accordance with old standard not only become obsolete, but also decrease its load-resistance due to repeated load from heavy trucks and corrosion due to salt damage. Among such bridges, a hinge section of a Gerber bridge is heavily damaged, and a crack occurs, in particular, because of shearing forces in a lot of hinge sections of existing Gerber bridges.

The damage of a hinge section of a Gerber bridge is characterized by:

(a) vertical crack of a support due to concentration of horizontal stress caused by expansion and contraction of girders which is caused by insufficient movement of a support of a hinge section, or by earthquake;

(b) deterioration and corrosion of reinforcing steel caused by water leakage from an expanded or contracted portion; and (c) oblique cracks in corners caused by lack of resistance to bending moment and shearing force.

As is seen in a bridge accident which recently occurred in Korea, if a hinge section is heavily damaged, the bridge itself may fall. Thus, it has long been an object to establish a reinforcing structure of a hinge section.

A conventional method of reinforcing a hinge section of a Gerber bridge is to fill the space in a hinge section with epoxy resin. However, in this method, girders are merely the adhered to each other by means of adhesive force of the epoxy resin. This method is somewhat advantageous if epoxy resin is filled before a hinge section is damaged, but cannot provide sufficient advantages once a hinge section has been damaged.

In another conventional method, a cable is formed between horizontal girders by means of which a reaction force is supported at the hinge section. Since almost all work for carrying out this method can be done on a lower surface of the bridge, it is possible to accomplish reinforcement construction without prohibiting vehicles from running on the bridge. However, a horizontal girder to which the cable is fixed unperferably receives a large horizontal load which has not been taken into consideration at initial design. In addition, this method cannot provide essential repair to a damaged hinge section. Furthermore, the cable is kept exposed to the atmosphere, and it is not preferable to use a cable in such a condition.

In still another conventional method, a cable is spanned between support girders which supports a girder hung from a hinge section, and a pre-stress is introduced to the hung girder by means of an out-cable system. However, a fixed girder supporting a hung girder therewith receives a large horizontal load. In addition, as the introduced pre-stress decreases, it becomes more difficult to stably keep the reinforcement effects.

In view of the foregoing problems in prior methods of reinforcing a hinge section, it is an object of the present invention to provide a reinforcement structure for a hinge section which accomplishes superior reinforcement effects and long-term stability.

DISCLOSURE OF THE INVENTION

In order to solve the above mentioned problems, the present invention provides a reinforcing structure for a hinge section of a Gerber bridge including first and second girders which are connected with each other through the hinge section, having reinforcing steels continuously established on at least one of upper and lower surfaces of the first and second girders, reinforcement established by covering at least one of the upper and lower surfaces of the first and second girders on which the reinforcing steels are established, with curing material, and filler which is injected into a space of the hinge section and then is cured, thereby the first and second girders being integrally connected with each other.

It is preferable that existing supports of the Gerber bridge such as fixed supports and roller supports are replaced with rubber supports in order to prevent occurrence of internal stress caused by horizontal stress and/or supporting points settlement of a Gerber bridge which are to be caused by uniting the two girders into a continuous bridge at a hinge section.

The rubber supports are used in place of conventional steel supports to which stresses are concentrated to thereby impart much damage entirely to a bridge when a large earthquake force acts thereon during earthquake. Thus, there has been developed a layered support including rubber and steel layers so that a support can be suitably deformed on earthquake to thereby absorb displacement of a bridge. There have been also developed an earthquake-resistant support (LRB) containing a lead plug therein to thereby have high attenuation property against earthquake, and a reaction force dispersion support (HDR) in which rubber itself is provided with high attenuation property.

In order only to prevent occurrence of internal stresses caused by uniting the two girders into a continuous bridge, it is not always necessary to replace all the supports with rubber supports. At least one support may remain fixed. However, it is preferable to replace all the supports with rubber supports in order to make behavior of the supports uniform after reinforcement is completed.

The rubber supports can provide an adequate frictional force even in a horizontal direction, they can work well in non-earthquake condition. However, it is preferable to form a raised portion for restricting horizontal movement of the girders during earthquake in order to prevent crush of a bridge in big earthquake.

As the curing material, there may be used polymer cement mortar having a strength of 240 kgf/cm$^2$ or greater in three hours after grouted. For instance, it is preferable to use polymer cement mortar commercially available from Kyouryou Hozen Inc. under the brand name of Hozen KH-PFC. It is also preferable to use high-speed curing type polymer cement mortar filler having both a strength of 240 kgf/cm$^2$ or greater in three hours after being grouted and fluidity for 40 to 75 seconds. For instance, there may be used Hozen KH-G, commercially available from Kyouryou Hozen Inc.

In accordance with the present invention, two girders are united at a hinge section of a Gerber bridge which does not transfer bending moment therethrough, by both RC (reinforced concrete) structure formed continuously over the adjacent two girders and cement mortar filler introduced into a space of a hinge section, thereby providing the same structure as that of a continuous bridge which transfers bending moment therethrough.

BEST MODE FOR CARRYING OUT THE INVENTION

Figures 1, 1A, 1B, 1C:
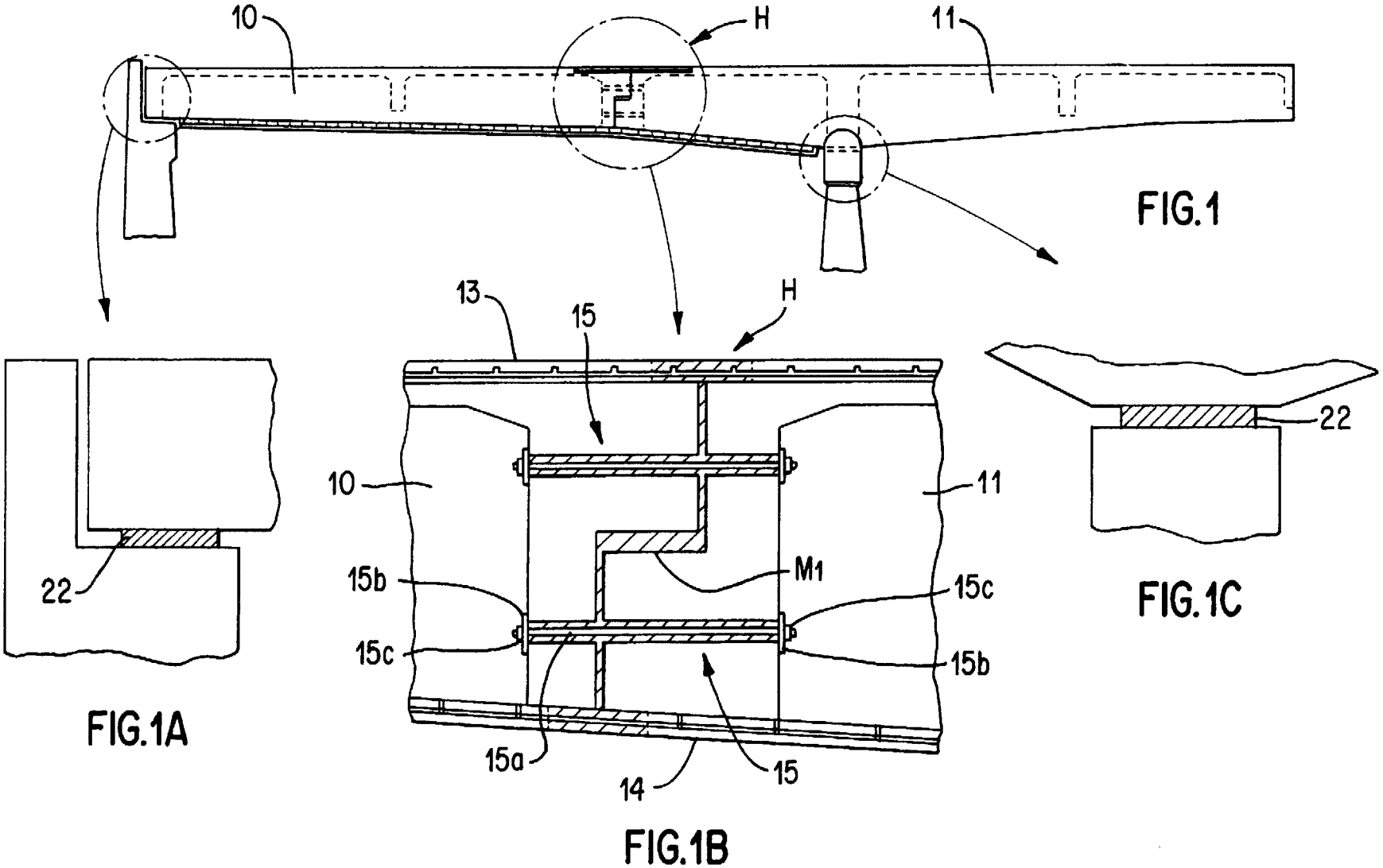
FIGS. 1, 1A, 1B, and 1C are side views illustrating an embodiment made in accordance with the present invention.

Hereinbelow will be described the advantageous features of the present invention in detail in connection with the embodiments illustrated in the drawings.

Figure 6:
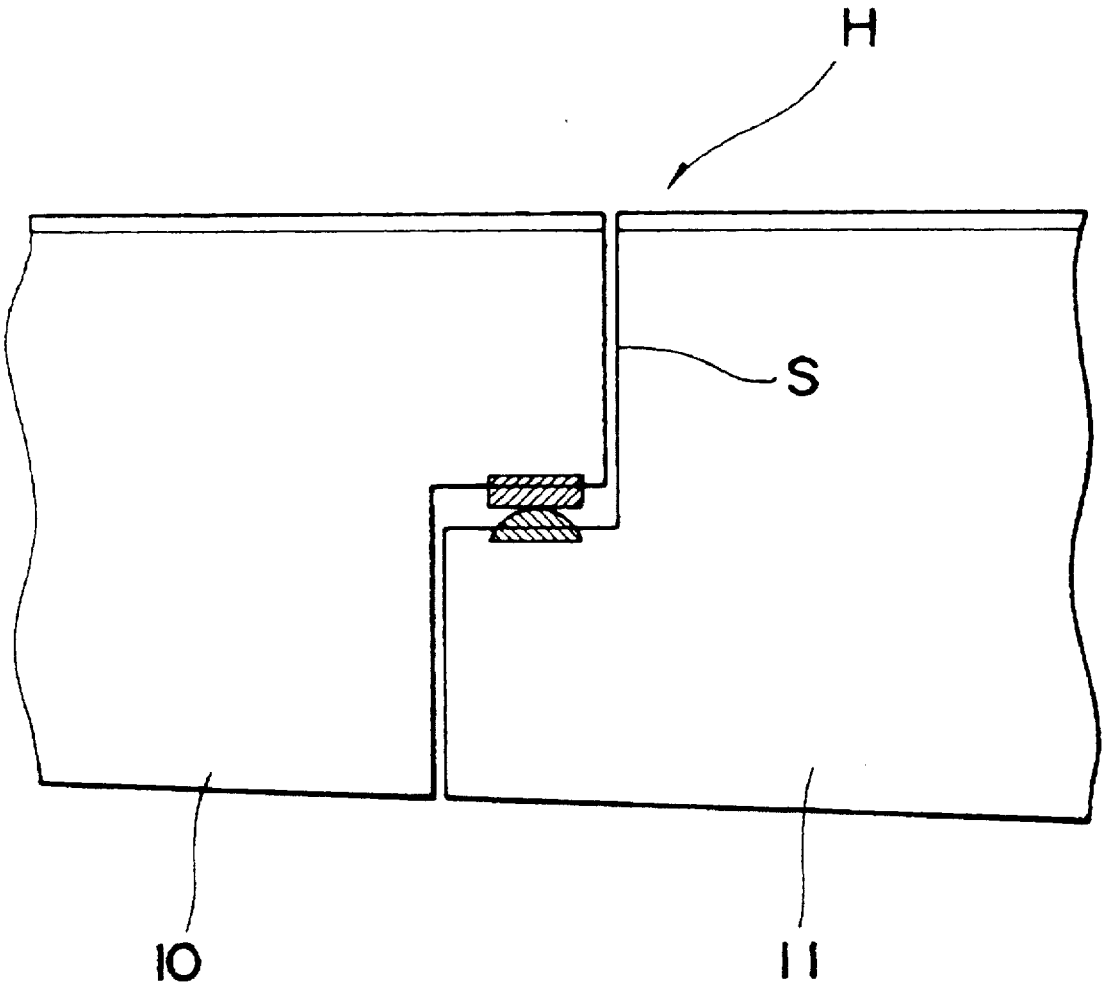
FIG. 6 is a side view of a hinge section before reinforced.

With reference to FIGS. 1 to 4, a reference numeral 10 indicates a first girder located at an end of a concrete made Gerber bridge, and a reference numeral 11 indicates a second girder supporting a right end of the first girder with a hinge section H located therebetween. As illustrated in FIG. 6, there is formed a space S between the first and second girders before reinforcement is completed. In this embodiment, upper surface reinforcement 13 and lower surface reinforcement 14 both having an RC structure are formed on both upper and lower surfaces of the hinge section H in order to unite the first and second girders 10 and 11 with each other.

The space S formed in the hinge section H is filled with high-speed curing type polymer cement mortar filler $M_1$ having both a strength of 240 kgf/cm$^2$ or greater in three hours after grouted and fluidity for 40 to 75 seconds (Brand name of Hozen KH-G commercially available from Kyouryou Hozen Inc.), and the filler is cured. Thus, the space S in the hinge section H is closed, and in addition, contact surfaces of the first and second girders 10 and 11 are adhered to each other by adhesive force of the high-speed curing type polymer cement mortar filler $M_1$.

Figure 2:
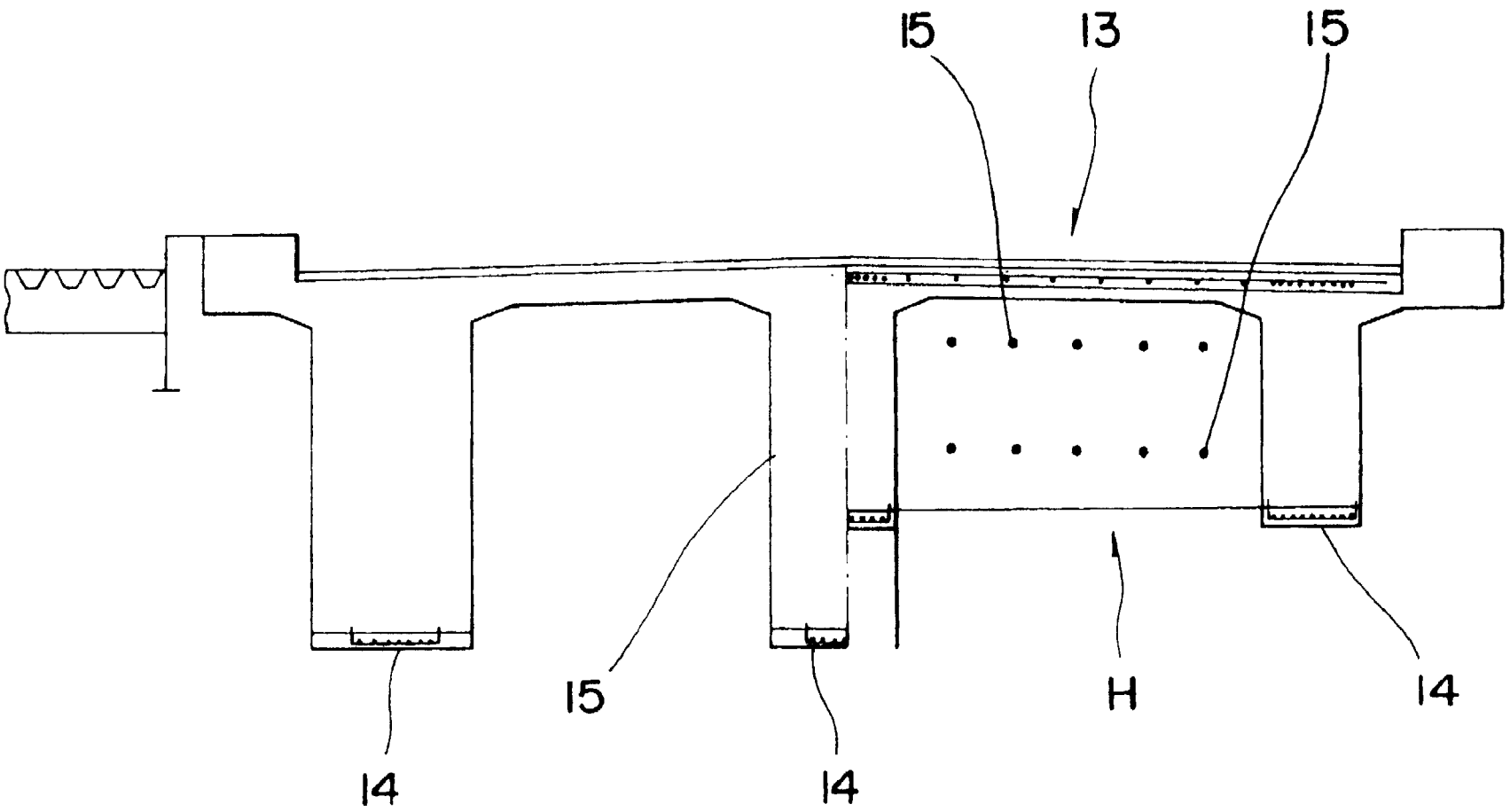
FIG. 2 is a front view of the embodiment of FIG. 1.

As best shown in FIG. 2, there are arranged connectors 15 in upper and lower rows in the hinge section H. The connectors 15 are comprised of bolts 15*a* inserted into through-holes formed through the hinge section H, and nuts 15*c* threaded to the bolts at their opposite ends with plates 15*b* therebetween, and unite the first and second girders 10 and 11 to each other by means of mechanical clamping force.

Figure 3:
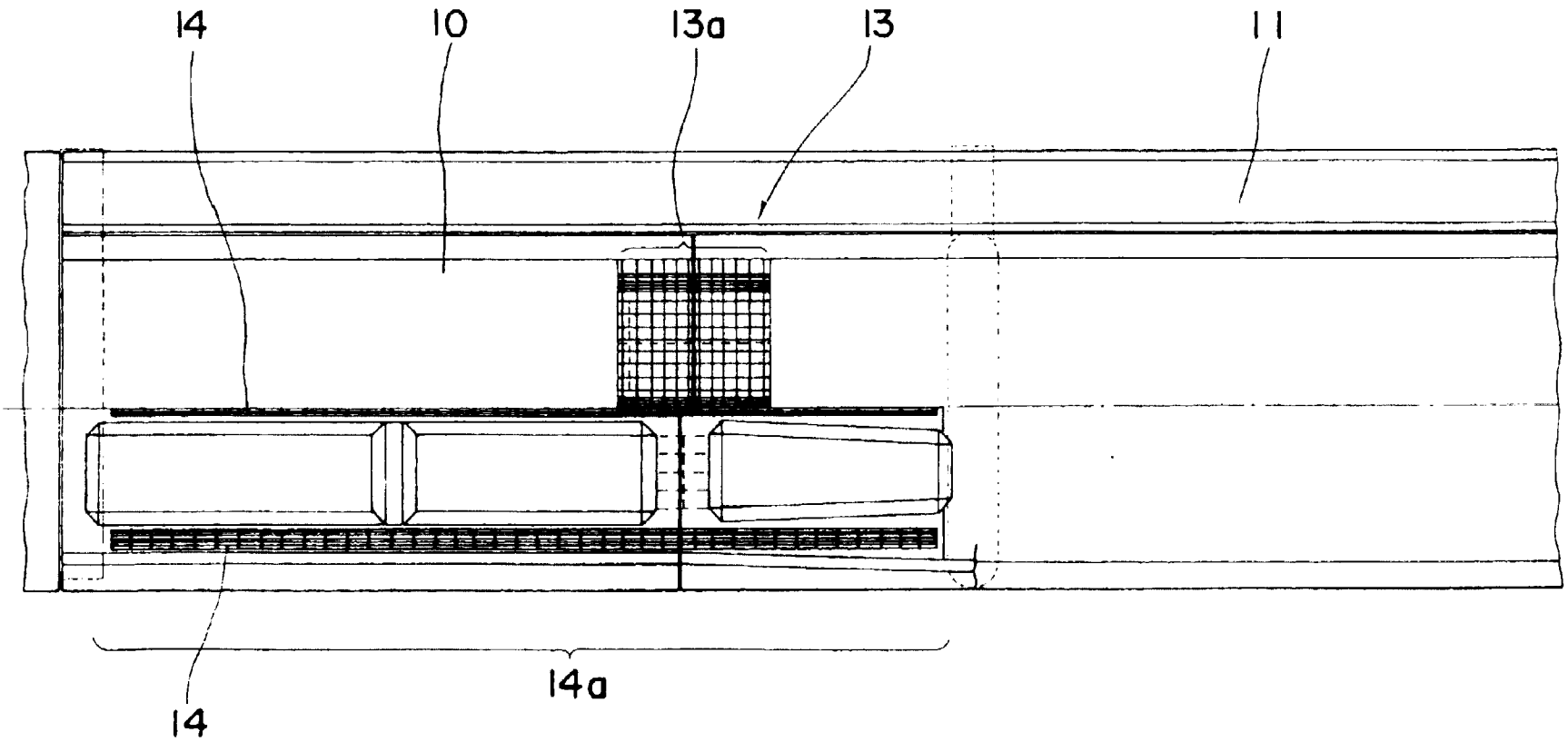
FIG. 3 is a plan view of the embodiment of FIG. 1, in which an upper half shows arrangement of reinforcing steels on an upper side of a girder and a lower half shows arrangement of reinforcing steels on a lower side of a girder.
Figure 4:
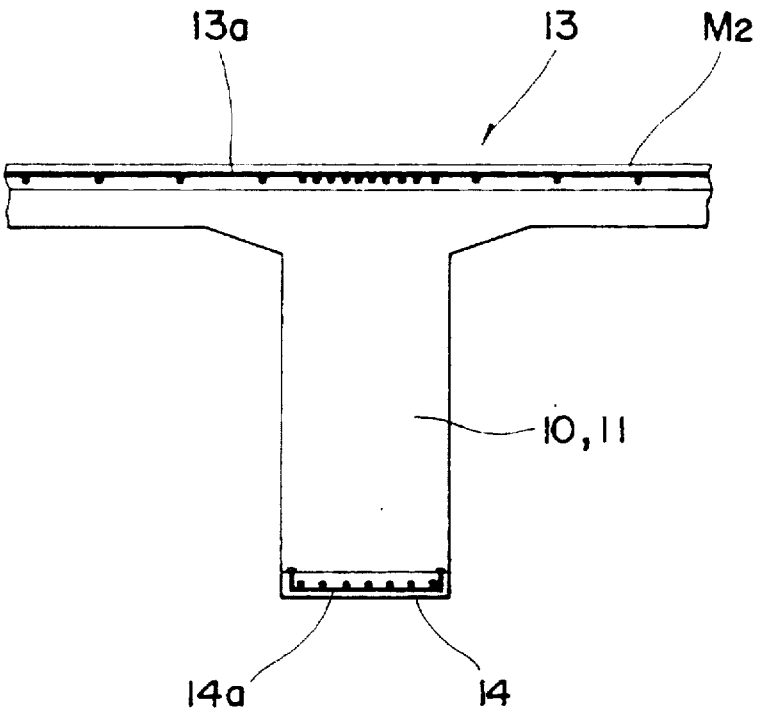
FIG. 4 is an enlarged front view of the gist.

An existing floor is flattened so that a surface after having been reinforced is on a level with a road, and thereafter, as illustrated in FIG. 3, reinforcing steels 13*a* are arranged continuously on upper surfaces of the first and second girders 10 and 11. Thus, the reinforcement 13 is established at either side of the hinge section H by a length of 1800 mm, namely on both the first and second girders 10 and 11, totally by a length of 3600 mm. As cement mortar $M_2$ to fill the reinforcement therewith, there was used polymer cement mortar having both a strength of 240 kgf/cm$^2$ or greater in three hours after having been grouted and rapid strength, fluidity and low expansion rate, commercially available from Kyouryou Hozen Inc. under the brand name of Hozen KH-PFC.

The lower surface reinforcement 14 is formed entirely over the first and second girders 10 and 11. The lower surface reinforcement is formed by arranging reinforcing steels 14*a* continuously across lower surfaces of the first and second girders 10 and 11 and using the cement mortar $M_2$ similarly to the upper surface reinforcement 13 so that stress transfer is not interrupted at the hinge section H. The reason why the reinforcement 14 is formed entirely over a lower surface of the hung girder or first girder 10, in particular, is to not only protect a lower surface of the girder which tends to be cracked, but also protect the first girder 10 from the increased bending moment accompanied with conversion in structure from a Gerber bridge to a continuous bridge.

Figure 5:
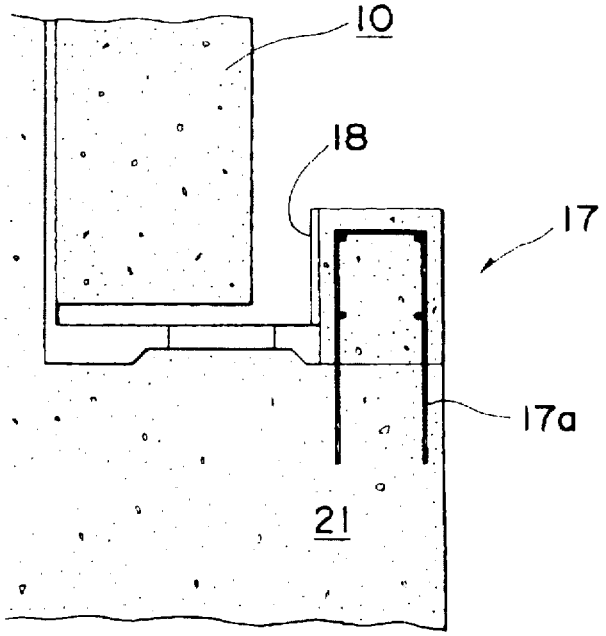
FIG. 5 is a schematic view illustrating a raised portion for restricting horizontal movement of a girder.

FIG. 5 illustrates a raised portion 17 formed on an abutment 21 and made of concrete reinforced with steel bars. The raised portion 17 is united to the abutment 21 by inserting steel bars 17*a* into holes formed in the abutment 21 with a drill. A reference numeral 18 indicates rubber adhered to a sidewall of the raised portion 17. The rubber acts as a cushion. Similarly, a pier is also formed with a raised portion. By forming raised portions 17, it is possible to restrict horizontal movement of a girder during earthquake to thereby prevent crashing of the bridge, even if all existing supports are replaced with rubber supports.

Hereinbelow are explained steps of constructing the above mentioned reinforcement structure with reference to FIGS. 1 to 5 and 7.

Figure 7A:
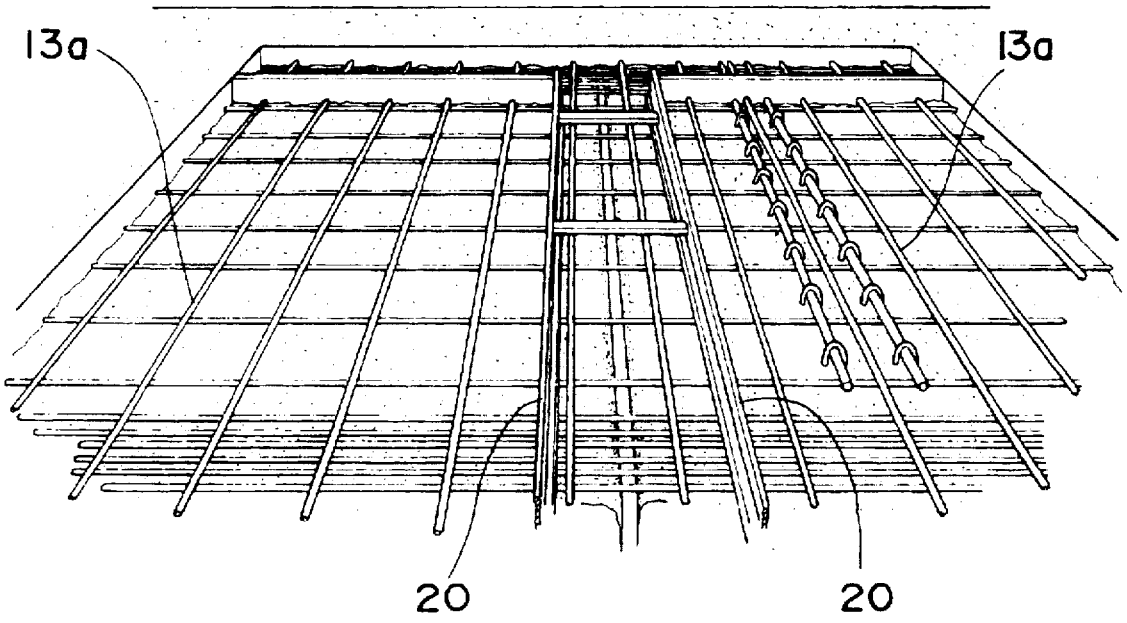
FIGS. 7A and 7B show respective steps of a reinforcement process.
Figure 7B:
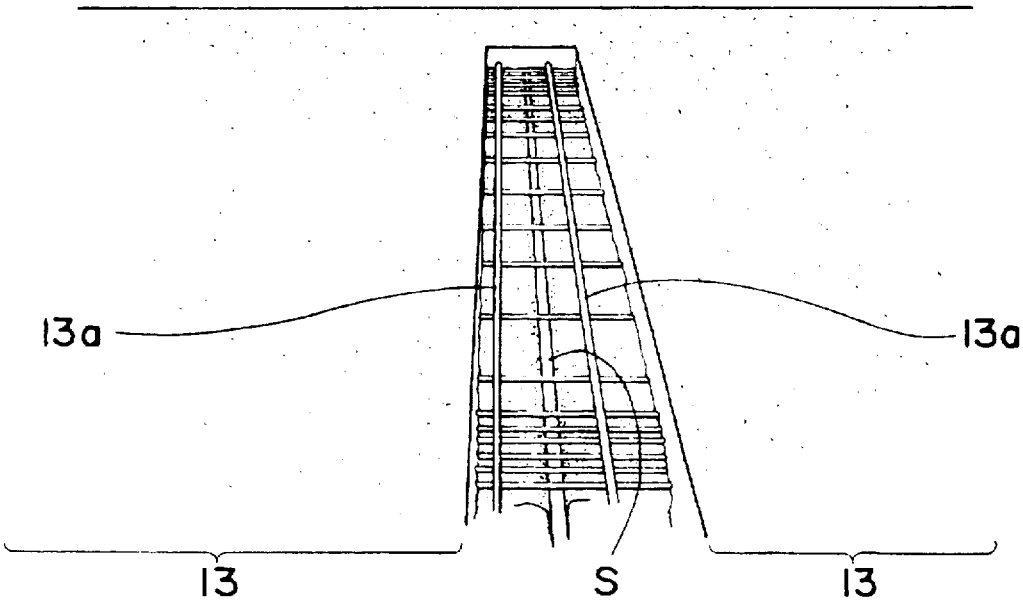

First, the upper surfaces of the first and second girders 10 and 11 with the hinge section H as a center, namely a floor in an area in which the upper surface reinforcement 13 is to be formed is flattened. Then, the reinforcing steels 13*a* are arranged in this area so that the reinforcement steels continuously cover the upper surfaces of the first and second girders 10 and 11. Then, as illustrated in FIG. 7(*a*), frames 20 are constructed at a distance from the space S of the hinge section H and with the space S as a center. The cement mortar $M_2$ is introduced into the upper surface reinforcement area except an area defined by the frames 20, and is made cured.

The increased thickness process is adopted with respect to the lower surface reinforcement 14. After the lower surfaces of the first and second girders 10 and 11 are washed, the reinforcing steels 14*a* are fixed onto the lower surfaces, and then, a frame (not illustrated) is constructed beneath the reinforcing steels 14*a*. Then, the cement mortar $M_2$ is introduced from an introduction opening into a space formed between the frame and the lower surfaces of the first and second girders 10 and 11, and then the mortar is cured.

Thereafter, the polymer cement mortar filler $M_1$ is introduced into the space S of the hinge section H through an opening formed by the frames 20, and then is cured. It is preferable to wash the space S with pressurized water prior to the introduction of the polymer cement mortar filler $M_1$ into the space S to thereby enhance adhesion between the polymer cement mortar filler $M_1$ and the first and second girders 10 and 11.

Then, through-holes are formed through the hinge section H in upper and lower rows by core trimming. The connectors 15 are inserted into the through-holes and fastened. Thus, the reinforcement for the hinge section is completed as illustrated in FIGS. 1 to 4.

After all existing supports of a Gerber bridge is washed with pressurized water to thereby remove wastes, the existing supports are all cut with a wire saw, and then rubber supports 22 are set up.

By forming the raised portion illustrated in FIG. 5 simultaneously with or after completion of the replacement of supports as mentioned above, it is possible to restrict horizontal movement of girders during earthquake to thereby prevent crashing of the bridge, even if the existing supports are all replaced with the rubber supports.

In accordance with the embodiment described so far, the two girders are united into one at the hinge section of a Gerber bridge which does not transfer bending moment therethrough by both the RC reinforcements 13 and 14 formed continuously over the girders 10 and 11, and the cement mortar filler $M_1$ introduced into the space of the hinge section, thereby providing the same structure as that of a continuous bridge which transfers bending moment therethrough. Thus, the above mentioned embodiment provides superior reinforcing effects and long-term stability.

The present invention provides the following advantages.

(1) The adjacent two girders are united into one at a hinge section of a Gerber bridge which does not transfer bending moment therethrough, by both RC (reinforced concrete) structure formed continuously over the adjacent two girders and cement mortar filler introduced into a space of a hinge section, thereby providing the same structure as that of a continuous bridge which transfers bending moment therethrough. Superior reinforcing effects and long-term stability are obtained.

(2) By replacing existing supports with rubber supports, it is possible to prevent occurrence of internal stress caused by horizontal stress and/or supporting points settlement of a Gerber bridge which are to be caused by uniting the two girders into a continuous bridge at a hinge section.

(3) By forming the raised portion for restricting horizontal movement of the girders during earthquake, it is possible to keep safety, even if all supports of an existing Gerber bridge are replaced with rubber supports.

(4) By using curing material and filler which generate sufficient strength in a short period of time, specifically, about three hours, it is possible to allow vehicles to run on a bridge in a short period of time after the reinforcement is completed, thereby exerting less influence on the traffic.

INDUSTRIAL APPLICABILITY

The present invention can be applied to newly built bridges as well as existing bridges. It is possible to fabricate girders in a factory and construct them at a construction site similarly to a Gerber bridge, thereby establishing a continuous bridge having superior strength.

I claim:

1. A method of reinforcing a Gerber bridge, having first and second girders having respective upper and lower surfaces, the girders being joined together at a hinge section, and supports supporting the first and second girders, comprising the steps of:

arranging a grid of reinforcing steel members on the upper and lower surfaces of the first and second girders at each side of the hinge section, and defining a frame around the hinge section;

filling polymer cement mortar into the frame to thereby bond the first and second girders at the hinge section;

forming through holes between the first and second girders at the hinge section; and inserting mechanical connectors in the through holes to reinforce the hinge section.

2. A method according to claim 1 further comprising, after said step of inserting the mechanical connectors, the step of cutting said supports and inserting resilient supports.

3. A method according to claim 2 further comprising the step of providing raised portions to restrict horizontal movement of said girders.

4. A method according to claim 2 wherein the raised portions comprise a resilient material.

5. A reinforced Gerber bridge, having first and second girders having respective upper and lower surfaces, the girders being joined together at a hinge section, and supports supporting the first and second girders, made by a method comprising the steps of:

arranging a grid of reinforcing steel members on the upper and lower surfaces of the first and second girders at each side of the hinge section, and defining a frame around the hinge section;

filling polymer cement mortar into the frame to thereby bond the first and second girders at the hinge section;

forming through holes between the first and second girders at the hinge section; and inserting mechanical connectors in the through holes to reinforce the hinge section.

6. A bridge made by the method according to claim 5 further comprising, after said step of inserting the mechanical connectors, the step of cutting said supports and inserting resilient supports.

7. A bridge made by the method according to claim 6, further comprising the step of providing raised portions to restrict horizontal movement of said girders.

8. A bridge made by the method according to claim 7 wherein the raised portions comprise an resilient material.

* * * * *